US008235297B2

(12) United States Patent
Stojak et al.

(10) Patent No.: US 8,235,297 B2
(45) Date of Patent: Aug. 7, 2012

(54) WRAPPED CONTAINER

(75) Inventors: Piotr Stojak, Cracow (PL); Przemyslaw Wolanin, Gm. Wieliczka (PL); Leszek Odziomek, Cracow (PL); Andrew Trofimiuk, Colombier (CH); Didier Graf, Eclépens (CH); Jiri Zeleny, Čáslav (CZ); Radek Zeleny, Čáslav (CZ); Jiri Riha, Zruč nad Sázavou (CZ)

(73) Assignee: Philip Morris USA Inc., Richmond, VA (US)

( * ) Notice: Subject to any disclaimer, the term of this patent is extended or adjusted under 35 U.S.C. 154(b) by 391 days.

(21) Appl. No.: 12/285,595

(22) Filed: Oct. 9, 2008

(65) Prior Publication Data

US 2009/0134230 A1 May 28, 2009

(30) Foreign Application Priority Data

Oct. 11, 2007 (EP) ..... 07254031

(51) Int. Cl.
*G06K 19/00* (2006.01)

(52) U.S. Cl. ..... 235/487

(58) Field of Classification Search ..... 235/494
See application file for complete search history.

(56) References Cited

U.S. PATENT DOCUMENTS

| | | | | | |
|---|---|---|---|---|---|
| 4,669,611 | A * | 6/1987 | Flaherty | 206/442 |
| 4,827,114 | A * | 5/1989 | Blachon | 235/487 |
| 5,427,235 | A | 6/1995 | Powell et al. | |
| 5,657,870 | A * | 8/1997 | Schottle et al. | 206/459.5 |
| 5,788,065 | A | 8/1998 | Focke | |
| 5,788,076 | A * | 8/1998 | Simmons | 206/459.5 |
| 6,880,313 | B1 * | 4/2005 | Gessford et al. | 53/442 |
| 2001/0010332 | A1 | 8/2001 | Bismarck et al. | |
| 2003/0052020 | A1 * | 3/2003 | Draghetti et al. | 206/245 |
| 2003/0119644 | A1 * | 6/2003 | Draghetti et al. | 493/480 |
| 2005/0086910 | A1 * | 4/2005 | Chambers et al. | 53/399 |
| 2005/0137940 | A1 * | 6/2005 | Lindsay | 705/26 |
| 2006/0118437 | A1 | 6/2006 | Gosebruch et al. | |
| 2009/0301921 | A1 * | 12/2009 | Kidwell | 206/459.5 |

FOREIGN PATENT DOCUMENTS

| | | | |
|---|---|---|---|
| EP | 1459988 A | | 9/2004 |
| GB | 2077696 A | | 12/1981 |
| JP | 02162087 A | * | 6/1990 |
| JP | 06155887 A | * | 6/1994 |

OTHER PUBLICATIONS

International Preliminary Report on Patentability mailed Apr. 22, 2010 for PCT/EP2008/008591.
European Search Report mailed Mar. 28, 2008 for Application No. 07254031.3.
International Search Report and Written Opinion mailed Feb. 5, 2009 for PCT/EP2008/008591.

* cited by examiner

*Primary Examiner* — Thien M. Le
*Assistant Examiner* — Christle Marshall
(74) *Attorney, Agent, or Firm* — Buchanan Ingersoll & Rooney PC

(57) ABSTRACT

A wrapped container of consumer products bearing one or more machine readable indicia is disclosed, wherein the machine readable indicia are applied to the wrapper. The portion of the wrapper to which the machine readable indicia are applied may be substantially transparent and the surface of the container behind the machine readable indicia substantially neutral. Alternatively, the portion of the wrapper to which the machine readable indicia are applied may be substantially opaque. A method of providing a wrapped container of consumer products comprises wrapping a container of consumer products with a wrapper; and applying one or more machine readable indicia to the wrapper.

23 Claims, 2 Drawing Sheets

WRAPPED CONTAINER

CROSS REFERENCE TO RELATED APPLICATION

This application claims priority under 35 U.S.C. §119 to European Application No. 07254031.3, filed Oct. 11, 2007, entitled WRAPPED CONTAINER, the entire content of which is hereby incorporated by reference.

FIELD OF THE INVENTION

The present invention relates to a wrapped container of consumer products having machine readable indicia and, in particular, to an over wrapped container of smoking articles, such as a pack of cigarettes.

BACKGROUND

Graphics and text are typically applied to the exterior of packaging for consumer products in order to communicate information to the consumer, such as brand, advertising, promotional or product information. In addition, machine readable indicia, such as bar codes, are commonly applied to the exterior of the packaging to provide information, such as the price of the product. This machine readable information may be read using a scanner or other suitable reader at the point of sale, or during distribution of the products. Typically, consumer information applied to the packaging does not change during the period of time between printing of the packaging and sale of the products. However, information encoded in the machine readable indicia may change during this period. In particular, the price of the products may vary over time and may also alter depending upon the retail outlet in which the products are being sold. When such information changes, large quantities of packaged consumer products may already exist with machine readable indicia encoded with incorrect or outdated information. The machine readable indicia on the existing packaged goods must be covered and replaced with new indicia, for example using an adhesive label printed with the new indicia, or the packaging discarded, with or without the products inside.

It would be desirable to be able to apply machine readable indicia, in particular bar codes, to the packaging of consumer products in such a way that the indicia may be readily updated or replaced when the information encoded by the machine readable indicia changes.

SUMMARY

Disclosed herein is a wrapped container of consumer products bearing machine readable indicia, wherein the machine readable indicia are applied to the wrapper.

The term "machine readable indicia" is used to refer to indicia that provide a representation of information in the form of a pattern or image, which may be read using a suitable machine reader, such as an optical scanner. Typically, the machine readable indicia convey little or no information to the consumer. The machine readable indicia may be, for example, a linear or two-dimensional bar code, a holographic image, human readable characters, or another machine readable pattern or image. The machine readable indicia encode information about the product inside the container to which the machine readable indicia are applied, such as pricing. The machine readable indicia may also assign a unique product code or identification number to the products, or may encode product authentication or product tracking information.

Preferably, the machine readable indicia on the wrapper include a bar code, such as a linear bar code, or a two dimensional bar code.

The provision of the machine readable indicia on the wrapper enveloping the container, rather than on the container itself, enables the machine readable indicia to be applied to the products at a different stage to the printing and filling of the container. Advantageously, when information relating to the products inside the container changes, modification or destruction of the container itself is not required, since a new wrapper with machine readable indicia providing the updated information can simply be provided.

Once the consumer has purchased the consumer products, the machine readable indicia are no longer required. Advantageously, when the wrapper is removed from the container after purchase, the machine readable indicia will be removed along with it. Therefore, by applying the machine readable indicia to the wrapper rather than directly on the container, the surface area of the container where the machine readable indicia would otherwise have been applied is instead available for printing, increasing the overall surface area of the container on which the manufacturer may print brand or consumer information, or decoration.

Preferably, the machine readable indicia are printed on the wrapper.

In a first embodiment, the portion of the wrapper to which the machine readable indicia are applied is substantially transparent and the surface of the container behind the machine readable indicia is substantially neutral.

The term "neutral" describes an area of the surface of the container that has been left substantially free of graphics and text. The area may be unprinted, or may be printed in a single, plain colour or texture that allows sufficient contrast to maintain machine readability of the indicia.

Containers of consumer products often include a display panel on their exterior surface to which machine readable indicia, such as a bar code, are applied. Typically, this display panel is always provided in the same position on the container to enable it to be located easily during production or shipment, or by the retailer. Preferably, the machine readable indicia are applied to the wrapper in the same position as the display panel, for ease of location. Application of the machine readable indicia to a substantially transparent portion of the wrapper in accordance with the first embodiment is particularly appropriate if the display panel is neutral, to avoid the underlying text or graphics interfering with the reading of the machine readable indicia. Alternatively, a neutral label may be applied over the display panel on the surface of the pack in order to render the display panel neutral. The visual appearance of the wrapped container is the same as a conventional wrapped container, in which the machine readable indicia are printed directly on the surface of the container and the overlying transparent wrapper is unprinted.

Alternatively, the container may be printed without a display panel, provided that the surface of the container over which the machine readable indicia will be applied is substantially neutral.

Preferably, the entire wrapper is substantially transparent, except for the indicia applied thereto. Advantageously, the graphics and text printed on the exterior surface of the container are therefore not obscured by the machine readable indicia. Alternatively, the wrapper may have brand, advertising, promotional or product information applied thereto. Typically, this information will be printed. The brand, advertising, promotional or product information applied to the wrapper may be the same as, or different to the information printed directly onto the exterior surface of the container. The information applied to the wrapper may cover or obscure a feature of the container which will be only apparent after the wrapper has been removed.

In a second embodiment, the portion of the wrapper to which the machine readable indicia are applied is substantially opaque, that is, not transparent or translucent, so that any graphics or text printed on the underlying display panel are not visible through the wrapper. This means any machine readable indicia which have been printed directly onto the display panel of the container will be covered by the opaque window, and the machine readable indicia on the container will be replaced with the machine readable indicia applied to the wrapper. This may be advantageous, for example, if the display panel on a container has previously been printed with machine readable indicia which encode information that is no longer correct. The information can be conveniently updated by providing new machine readable indicia on the wrapper, which covers the old machine readable indicia on the container and encodes the new, corrected information. Unlike when a label is used to provide new machine readable indicia, the wrapped container incorporating the updated indicia has virtually the same appearance as if a completely transparent wrapper had been used.

Alternatively, the container may be printed without providing a display panel so that a larger surface area of the container is available for the provision of decorative indicia, or indicia providing consumer information. Once the wrapper is removed from the container, the portion previously covered by the opaque portion of the wrapper is exposed to the consumer.

Preferably, the opaque portion has a surface structure that increases the print quality of the machine readable indicia applied thereon. For example, the opaque portion may have an increased roughness over the standard wrapper, such that ink adheres better to the opaque portion.

The wrapper may be formed from any suitable material or combination of materials, including, for example, paper, metallised paper, metal foil or plastic. Preferably, the wrapper is a film, more preferably a plastic film, in particular a film based on one or more polyolefins. For example, the wrapper may be a transparent polyethylene or polypropylene film. Most preferably, the wrapper is a transparent, polypropylene film. Preferably, the wrapper includes a tear tape.

The container may be formed from any suitable material or combination of materials including, for example, paper, cardboard, metal or plastic. Where the container is a container of smoking articles it may be an individual hard or soft pack comprising a plurality of smoking articles such as, for example, cigarettes, cigarillos, cigars or tobacco portions, or a display carton comprising a plurality of individual packs of smoking articles. Preferably, the container is a pack of cigarettes.

Preferably, when the container is a pack of cigarettes, the display panel is provided on a side wall of the pack.

A method of providing a wrapped container of consumer goods bearing one or more machine readable indicia comprises: wrapping a container of consumer goods with a wrapper; and applying one or more machine readable indicia to the wrapper.

In one embodiment, the method comprises: wrapping a container having a substantially neutral portion on the surface thereof with a wrapper having a substantially transparent portion, such that the substantially transparent portion of the wrapper overlies the substantially neutral portion of the container; and applying machine readable indicia to the substantially transparent portion of the wrapper.

In an alternative embodiment, the method comprises: wrapping a container having first machine readable indicia printed thereon with a wrapper having a substantially opaque portion, such that the substantially opaque portion overlies the first machine readable indicia; and applying second machine readable indicia to the opaque portion.

Preferably, the machine readable indicia are applied by printing. Preferably an on-line printing process is used. The term "on-line printing process" is used to describe a printing process that is carried out during the making or wrapping of the pack. The printing may be applied by gravure, ink jet, hot foil stamping or laser printing, particularly laser printing with thermo-sensitive or light sensitive ink.

DETAILED DESCRIPTION

Figure 1:
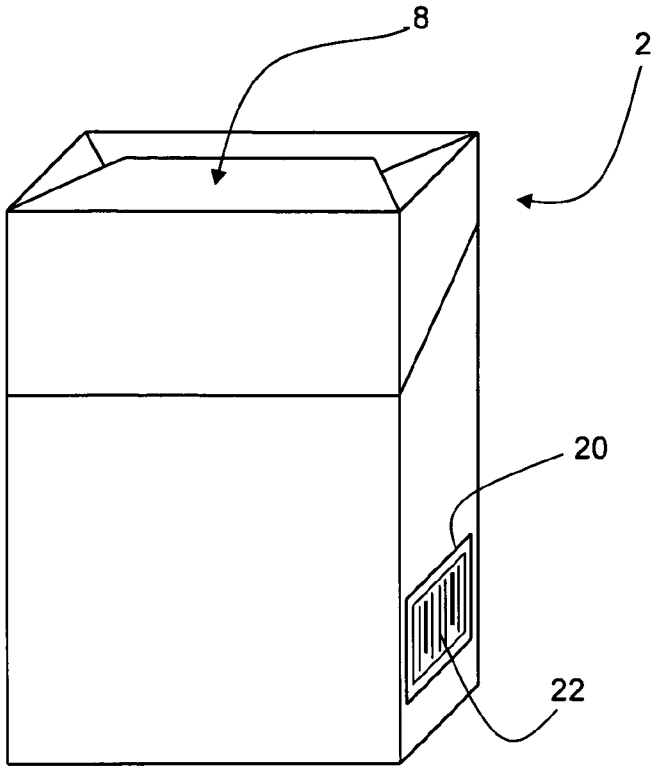
FIG. 1 shows a wrapped container according to the second embodiment of the present invention.
Figure 3:
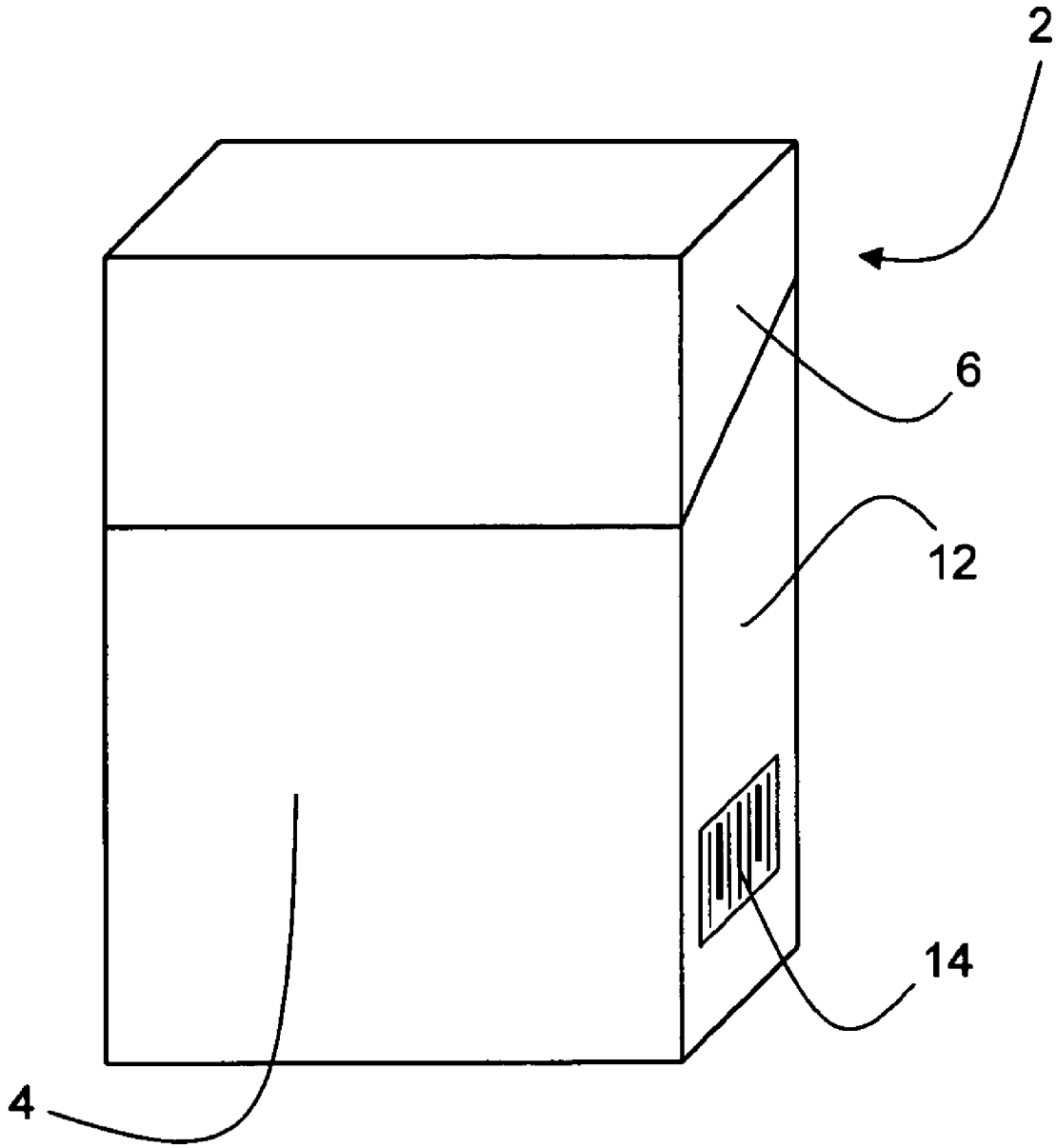
FIG. 3 shows the unwrapped container of FIG. 1.

The container 2 shown in FIGS. 1 and 3 is a rectangular parallelepiped and is of identical construction to a conventional hinge-lid cigarette pack, comprising a lower box portion 4 and an upper lid portion 6 that is hinged to the rear wall of the lower box portion 4. The container is enveloped by an over wrapper 8 of polypropylene film.

As shown in FIG. 3, a rectangular display panel 10 is provided on the exterior surface of the right hand side wall 12 of the lower box portion 4. The display panel contains a first linear bar code 14, consisting of a series of parallel vertical bars of varying widths and height, which is encoded with information relating to the product within the container, such as the pricing, the expiry date, the production place, the production time or combinations thereof.

Figure 2:
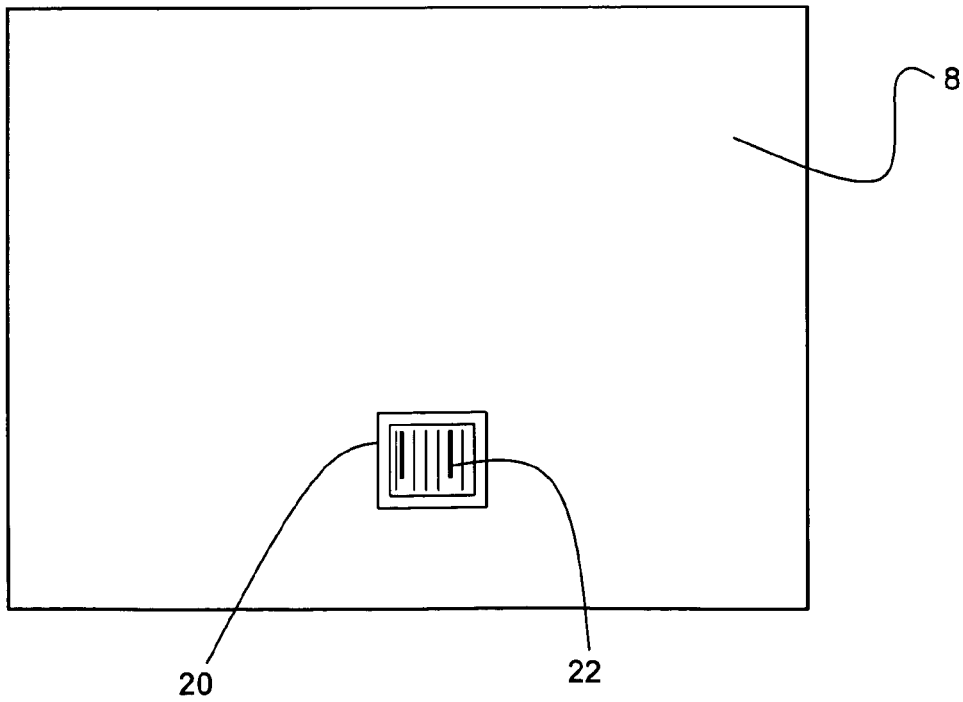
FIG. 2 shows the wrapper used to wrap the container of FIG. 1.

As shown in FIG. 2, the wrapper is a rectangular sheet of polypropylene, of the type and size conventionally used to wrap cigarette packs. The wrapper is generally transparent but is provided with an opaque rectangular window 20, onto which has been printed a second linear bar code 22, encoding different information to the information encoded in the first bar code 14 printed directly on the side wall 12 of the container. The second bar code 22 in the opaque window 20 of the wrapper 8 is identical in size to the first bar code 14 on the side wall 12 of the container, while the opaque window 20 is slightly larger than the first bar code 14 such that an opaque band of the window is provided around the edges of the first bar code 14. The increased size of the opaque window 20 facilitates the registration between the opaque window 20 and the underlying first bar code 14 on the side wall 12 of the container, if present.

As shown in FIG. 1, the wrapper 8 is folded around the container and fixed using an adhesive in a conventional manner, such that the opaque window 20 of the wrapper 8 overlies and entirely covers the display panel 10 on the side wall 12 of the container and so that the bar codes overlie one another. The first bar code 14 on the side wall 12 of the container is not visible through the opaque window 20 of the wrapper 8. Therefore, a bar code scanner will read the second bar code 22 on the wrapper and 8 will not detect the underlying first bar code 14 on the container.

The second bar code 22 is readable using a conventional bar code scanner, such as the visible red light scanners commonly used in retail outlets to determine the price of goods at the point of sale.

Wrapped containers according to the first embodiment may have substantially the same construction as the container shown in the figures. However, the display panel on the side wall of the container is left neutral and a wrapper with a transparent section to which the indicia have been applied is used.

The invention claimed is:

1. A wrapped container of consumer products, comprising:

a single container of consumer products having a first machine readable indicia applied thereto; and a wrapper having an opaque window, the opaque window having a second machine readable indicia applied thereto, and wherein the opaque window overlies and entirely covers the first machine readable indicia on the single container of consumer products, and wherein the wrapper is transparent except for the opaque window such that graphics or text printed on an exterior surface of the single container are not obscured by the wrapper.

2. A container according to claim 1 wherein the second machine readable indicia is encoded with different information than the first machine readable indicia.

3. A container according to claim 1 wherein the second machine readable indicia is printed on the wrapper.

4. A container according to claim 1 wherein the opaque window is a rectangular opaque window.

5. A container according to claim 1 wherein the first and second machine readable indicia are linear bar codes.

6. A container according to claim 1 wherein the container of consumer products is a rectangular parallelepiped having at least one side wall, and the first machine readable indicia is printed on the at least one side wall of the container.

7. A container according to claim 6 wherein the container of consumer products is a cigarette pack and the wrapper is a rectangular sheet, which wraps around the cigarette pack.

8. A container according to claim 1 wherein the opaque window is slightly larger than the first machine readable indicia on the container of consumer products such that an opaque band of the opaque window is provided around an outer edge of the first machine readable indicia.

9. A container according to claim 8 wherein the first and second machine readable indicia are approximately identical in size.

10. A container according to claim 1 wherein the opaque window has an increased roughness as compared to the wrapper.

11. A container according to claim 1 wherein the wrapper includes a tear tape.

12. A container according to claim 1 wherein the single container of consumer products is a rectangular parallelepiped, and the wrapper is a rectangular sheet, which wraps around the single container of consumer products.

13. A method of providing a wrapped container of consumer products bearing machine readable indicia comprising:

wrapping a single container of consumer products having a first machine readable indicia applied thereto with a wrapper having an opaque window, the opaque window having a second machine readable indicia applied thereto, and wherein the opaque window overlies and entirely covers the first machine readable indicia on the single container of consumer products, and wherein the wrapper is transparent except for the opaque window such that graphics or text printed on an exterior surface of the single container are not obscured by the wrapper.

14. A method according to claim 13 comprising applying the second machine readable indicia to the opaque window after wrapping the container of consumer products with the wrapper.

15. A method according to claim 13 wherein the first and second machine readable indicia are applied by printing.

16. A method according to claim 15 wherein the printing step is carried out on-line.

17. A method according to claim 13 wherein the container of consumer products is a rectangular parallelepiped having at least one side wall, and the first machine readable indicia is printed on the at least one side wall of the container.

18. A method according to claim 17 wherein the container of consumer products is a cigarette pack and the wrapper is a rectangular sheet, which wraps around the cigarette pack.

19. A method according to claim 13 wherein the opaque window is slightly larger than the first machine readable indicia on the container of consumer products such that an opaque band of the opaque window is provided around an outer edge of the first machine readable indicia.

20. A method according to claim 13 wherein the opaque window has an increased roughness as compared to the wrapper.

21. A method according to claim 13 wherein the wrapper includes a tear tape.

22. A single wrapped container of consumer products bearing first machine readable indicia applied to the container and second readable machine indicia applied to a substantially opaque portion of a substantially transparent wrapper, wherein the substantially opaque portion of the wrapper covers the first machine readable indicia, and wherein the first and second machine readable indicia are each a linear or two-dimensional bar code and the first machine readable indicia is encoded with different information than the second machine readable indicia.

23. A method of providing a wrapped container of consumer products bearing first and second machine readable indicia comprising:

wrapping a single container of consumer products having first machine readable indicia printed thereon with a substantially transparent wrapper having a substantially opaque portion, such that the substantially opaque portion overlies the first machine readable indicia; and applying second machine readable indicia to the substantially opaque portion of the wrapper.

* * * * *